United States Patent [19]

Bresson et al.

[11] 4,292,611

[45] Sep. 29, 1981

[54] HIGH-SPEED AUTOMATIC TRIPPING CONTACTOR

[75] Inventors: Raymond Bresson; André P. Ducluzaux, both of Grenoble, France

[73] Assignee: Merlin Gerin S.A., Grenoble, France

[21] Appl. No.: 135,271

[22] Filed: Mar. 31, 1980

[30] Foreign Application Priority Data

Apr. 9, 1979 [FR] France ..... 79 09123

[51] Int. Cl.[3] ..... H01H 77/10

[52] U.S. Cl. ..... 335/6; 335/16; 335/147; 335/174

[58] Field of Search ..... 335/6, 16, 175, 266, 335/132, 174, 147

[56] References Cited

U.S. PATENT DOCUMENTS

| | | | |
|---|---|---|---|
| 2,897,408 | 7/1952 | Kesselring et al. | 335/195 |
| 3,979,675 | 9/1976 | Maier | 335/16 |
| 4,077,026 | 2/1978 | Slade et al. | 335/16 |

FOREIGN PATENT DOCUMENTS

| | | |
|---|---|---|
| 1808730 | 7/1969 | Fed. Rep. of Germany . |
| 2373143 | 6/1978 | France . |

*Primary Examiner*—Harold Broome

*Attorney, Agent, or Firm*—Stevens, Davis, Miller & Mosher

[57] ABSTRACT

A fast opening contactor comprising an electrodynamic repulsion trip device associated to a standard contactor unit so as to operate the contacts towards the open position against the electromagnetic attraction force in response of a short-circuit current.

9 Claims, 2 Drawing Figures

HIGH-SPEED AUTOMATIC TRIPPING CONTACTOR

This invention relates to an electromagnetic contactor having a contactor unit comprising:

a coil wound on a stationary magnetic core which attracts a movable armature of magnetic material upon energization of said coil, a movable contact carrier secured mechanically to said armature so as to be actuated between an open position and a closed position of contactor, a stationary contact cooperating with a movable contact supported by said contact carrier, said contacts coming into engagement with each other in the closed position and being maintained in this position upon attraction of said movable armature against the magnetic core, bias means urging a movable element comprising said armature and said contact carrier towards the open position upon deenergization of said coil.

Such known electromagnetic contactors of the prior art may perform a great number of closing and opening operations actuated by a manual or remote control device. These contactors may protect an electrical motor in response of an overload current above a predetermined value, but are not suitable to interrupt high short-circuit currents. Current limiting fuse elements or automatic circuit-breakers are frequently associated to these known electromagnetic contactors to ensure the short-circuit protection. The disconnecting function is generally performed by an additional isolator or disconnecting switch. A circuit breaker may ensure the short-circuit protection and the disconnecting function, but the mechanical endurance of its operating mechanism is limited. An electrical equipment having a contactor and an associated circuit-breaker is onerous and requires a great space.

It has been noted in accordance with the invention that electrical contactors and circuit-breakers have a great number of similar components, such as line terminals, contacts, arc extinguishing chambers, current detectors, etc. The object of the invention is to provide an electrical apparatus ensuring the two contactor and circuit-breaker functions with common base components and including an additional high-speed repulsion electrodynamic trip device which is associated to said contactor unit to move the contacts towards the open position against the electromagnetic attraction developed between the armature and the core of said contactor unit.

Another object of the invention is to arrange the additional electrodynamic trip device within an insulating case so as to form an independent module which may be joined side by side to the housing of a contactor unit. This modular arrangement uses a standard contactor and an electrodynamic trip device of predetermining rating so as to reduce the stocking space and the manufacture costs of such equipments.

Another object of the invention is to provide a high-speed automatic tripping contactor, in which a connecting member, such as a striker, is arranged between the contactor unit and the electrodynamic trip device to transmit a fast opening operating force to the movable element of contactor in response of a short-circuit current. The electrodynamic trip device remains inactive during the normal operation of contactor, and becomes active upon occurrence of a fault current above a predetermined value.

In the case of a multi-pole contactor, the contact carrier, the closing electromagnet and the electrodynamic trip device are common to the different poles.

According to another object of the invention, the electrodynamic trip device comprises mechanical interlocking means which cooperates with the operating striker in the contact open position so as to ensure the holding of the contactor in this position and to indicate the opening of the contacts.

Other advantages and characteristics will become apparent from the following detailed description of an embodiment of the invention, given by way of illustration and shown in the accompanying drawings in which.

Figure 2:
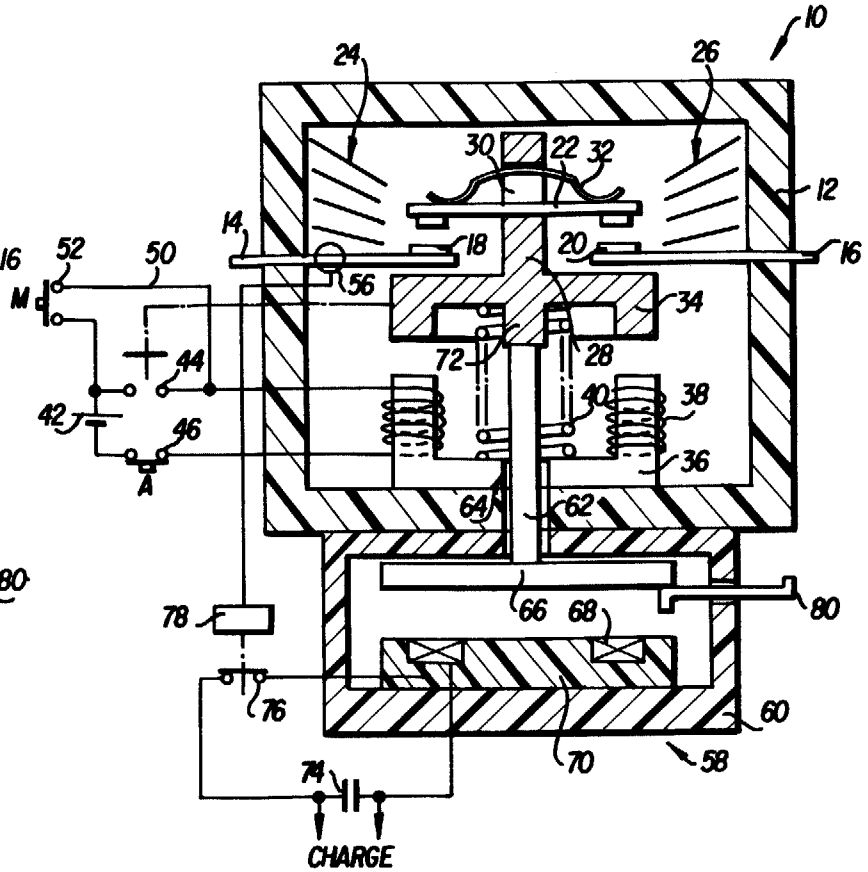
FIG. 2 is a view similar to that of FIG. 1, showing the contactor in the contact open position.

Referring to the drawings, a contactor unit 10 comprises a molded housing 12 of electrically insulating material, including opposite line terminals 14, 16 electrically connected to stationary contacts 18, 20 which cooperate with a movable bridging contact member 22. An arc extinguishing chamber 24, 26 including an arc chute is disposed near each pair of stationary and movable contacts 18, 22; 20, 22, in a conventional manner. The contactor is a multi-pole contactor, and the different poles are arranged in the same housing 12. The movable bridging contact members 22 of the different poles are mounted on a single slidable contact carrier 28 actuated between the open and closed positions of the contacts 18, 20, 22. Each movable bridging contact member 22 extends through an opening 30 arranged in the contact carrier 28. A leaf-spring 32 is lodged in each opening 30 and holds the corresponding bridging contact member 22 against the lower end of the opening 30.

The slidable contact carrier 28 is secured to the upper portion of a movable U-shaped armature 34 which cooperates with a stationary magnetic core 36. An energizing coil 38 is wound on the two legs of the U-shaped core 36 so as to form a well-known electromagnetic actuating device which displaces in operation the movable element of contactor, including armature 34, contact carrier 28 and bridging contact members 22. Bias means, such as a coil-spring 40 is inserted between the lower portion of core 36 and armature 34 so as to urge the movable element towards the contact open position. The closing of contactor 10 and the holding of the contacts in the closed position occur after attraction of armature 34 against core 36 when coil 38 is energized by a suitable direct current generator, such as a battery 42. The electrical supply circuit of coil 38 comprises a self-holding contact 44 electrically connected in series with a break contact 46 so as to interrupt the electrical power supply of coil 38 when any one of said contacts 44, 46 is in the open position. The movable armature 34 controls the self-holding contact 44 which is closed when armature 34 is attracted and held in constant contact against core 36. The opening of contact 44 occurs when armature 34 is actuated in the unattracted position upon deenergization of coil 38. An electrical control device 50 having a push-button switch 52, shunts the self-holding contact 44 so as to maintain the energization of coil 38, upon attraction of armature 34, even after releasing of the push-button of switch 52.

The contactor unit 10 is a conventional standard contactor having a rest position where contacts 18, 20, 22 are normally open. In operation, the energization of coil 38 resulting after closing of push-button switch 52, attracts the armature 34 against core 36 to actuate the contacts 18, 20, 22 to the closed position. The self-holding contact 44 is closed thereby to maintain the energization of coil 38. The supply of coil 38 may be interrupted upon opening of one of the contacts 44, 46 effected by a manual or automatic control device (not shown). The contactor unit 10 is provided with an electrodynamic repulsion trip device 58 to constitute a high speed automatic tripping contactor in response of very high overload or short-circuit currents. The electrodynamic trip device 58 is located within an insulating case 60 secured by screws (not shown) to the undersurface of housing 12 including contactor unit 10. An operating elongated striker 62 extends through aligned openings 64 arranged in the housing 12 and case 60, and is slidable mounted in the opening direction of the movable element 34, 28, 22 of contactor unit 10. One end of the striker 62 is mechanically fastened to an annular disc 66 of conductive material located within case 60 in front of a winding 68 embedded in a stationary support element 70. The opposite end of striker 62 cooperates with a stop member 72 carried by the movable armature 34 so that a small gap is provided between stop member 72 and striker 62 when armature 34 is the attracted position.

Winding 68 of the electrodynamic trip device 58 is electrically connected to a bank of capacitors 74 through a control switch 76. The charging circuit of the capacitors is not shown in the figures. The closing of switch 76 actuates the discharge of capacitors 74 into winding 68, thus producing electrodynamic repulsion forces between winding 68 and the associated movable disc 66 which transmit the motion to the striker 62. The switch 76 is controlled by an automatic control circuit 78 connected to a current transformer 56 surrounding a conductor connecting the terminal 14 to the stationary contact 18. The closing of switch 76 is actuated by control circuit 78 when the current flowing through contactor unit 10 exceeds a predetermined value.

Locking means such as a slidable retaining latch 80, cooperates in the active locked position with the conductive disk 66 which is locked in the lifted repulsion position so as to maintain the contacts of contactor unit 10 in the open position upon the occurrence of a short-circuit current. Latch 80 may be actuated from the outside of case 60 and is operated in the active locked position only when the disk 66 reaches the lifted repulsion position corresponding to the opening of the contactor. This position of latch 80 proves the opening of the contacts and provides further a disconnecting function.

According to another embodiment of the invention (not shown in the figures) the retaining latch 80 may be omitted and other locking means could be used to maintain the movable element in the open position of contactor, such as an interlocking device of the striker 62.

Figure 1:
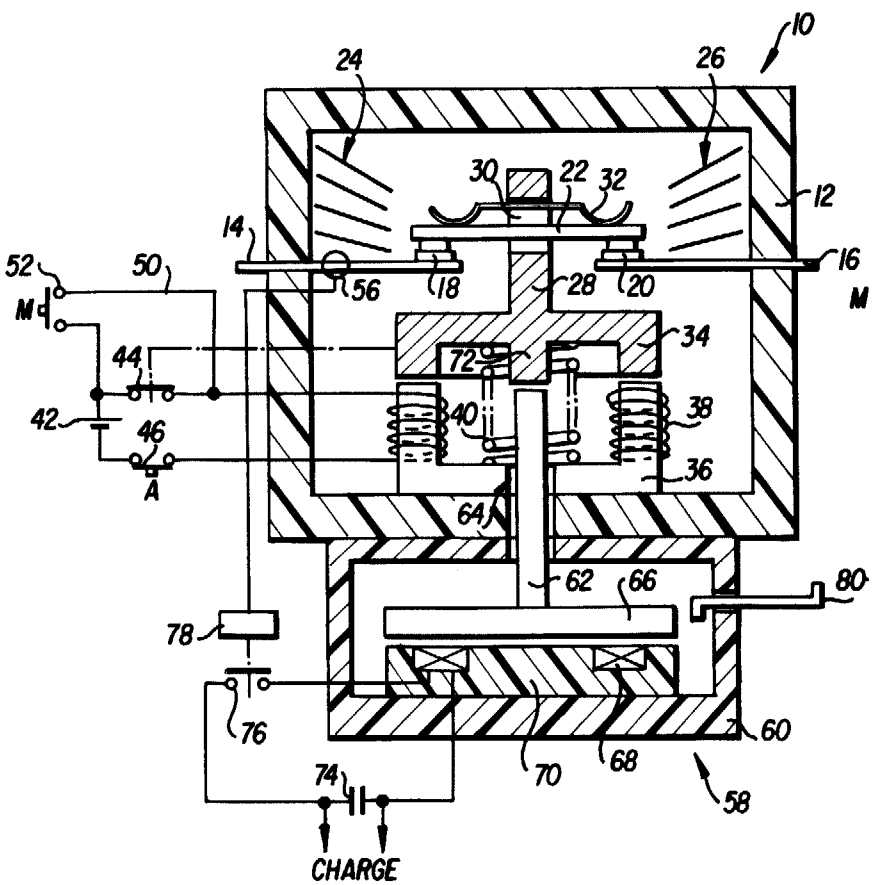
FIG. 1 is a vertical sectional view of a contactor in the contact closed position.

The working of the contactor is as follows:

In the contact closed position of contactor shown in FIG. 1, the energization of coil 38 maintains the movable element 34, 28, 22 in the attracted position. The normal opening of contactor occurs after deenergization of coil 38 effected by a manual operating member which opens the electrical supply circuit. The actuating of the push-button switch 52 ensures the closing of contactor. During this normal working of contactor, the electrodynamic trip device 58 remains inactive.

Upon the occurrence of a short-circuit current detected by the current transformer 56, the control circuit 78 ensures the closing of switch 76. The coil 68 is energized by the discharge of capacitors 74, thus producing an electrodynamic repulsion of disc 66 which is moved in the opening direction. During this opening movement, striker 62 comes into engagement with stop member 72 of the armature 34 which is thrust away core 36 towards the unattracted position. The movable element 34, 28, 22 is rapidly lifted into the contact open position, whereby the self-holding contact 44 is simultaneously opened to ensure the deenergization of coil 38. Spring 40 maintains the contacts 18, 20, 22 in the open position. The electrodynamic repulsion effect of the trip device 58 overcomes the electromagnetic attraction of armature 34. The high-speed automatic tripping contactor has a predetermined breaking capacity so as to ensure the function of a circuit breaker. The closing of contactor is effected normally when push-button switch 52 is closed. The electrodynamic trip device 58 may also constitute a remote high speed opening control device.

The movable element 34, 28, 22 of the contactor may be locked in the contact open position by latch 80 coming into engagement with the under surface of the repelled disc 66. A spring (not shown) urges disc 66 and striker 62 into the lifted repulsion position, and the active locked position of latch 80 indicates the opening of the contacts and the disconnecting of contactor.

The electrodynamic repulsion trip device 58 may be associated to other standard contactors, such as remanent contactors.

What is claimed is:

1. An electromagnetic contactor having a contactor unit comprising:

a coil wound on a stationary magnetic core which attracts a movable armature of magnetic material upon energization of said coil, a movable contact carrier secured mechanically to said armature so as to be actuated between an open position and a closed position of contactor, a stationary contact cooperating with a movable contact supported by said contact carrier, said contacts coming into engagement with each other in the closed position and being maintained in this position upon attraction of said movable armature against the magnetic core, bias means urging a movable element comprising said armature and said contact carrier towards the open position upon deenergization of said coil, a high-speed electrodynamic trip device associated to said contactor unit and including a control winding, a movable conductive disc arranged in front of said winding and a striker secured to said disc so as to strike said movable element upon energization of said control winding ensuring an electrodynamic repulsion of said disc which moves said movable element towards the open position against the electromagnetic attraction forces developed between said armature and core.

2. An electromagnetic contactor according to claim 1, in which said electrodynamic trip device forms an independent module joined side by side to the contactor unit of a standard contactor so that said striker cooperates with a conjugate member of said movable element.

3. An electromagnetic contactor according to claim 2, wherein the electrical supply circuit of said coil comprises a self-holding contact which is either in a first closed position to ensure the energization of said coil and the electromagnetic attraction of said armature against the associated core, or in a second separated position to interrupt the supply of said coil when said movable element is moved towards the contact open position.

4. An electromagnetic contactor according to claim 3, wherein said contact carrier is slidable mounted between the open and closed positions of the contactor, and comprises a contact bridge member cooperating with a pair of stationary contacts.

5. An electromagnetic contactor according to claim 4, wherein a detector cooperates in response with a short-circuit current with an automatic control circuit to operate said electrodynamic trip device towards the contact open position independently of the manual opening mechanism of said contactor.

6. An electromagnetic multi-pole contactor according to claim 1, wherein the armature, the contact carrier and the electrodynamic trip device are common to the different poles.

7. An electromagnetic contactor according to claim 1, wherein a releasable latch locks said movable element in the contact open position so as to ensure the disconnecting of the contactor.

8. An electromagnetic contactor according to claim 7, wherein said latch cooperates with said striker of the electrodynamic trip device.

9. An electromagnetic contactor according to claim 1, wherein the remanent magnetization of said core holds said armature in the attracted position.

* * * * *